US006015368A

United States Patent [19]

Clem et al.

[11] Patent Number: 6,015,368

[45] Date of Patent: Jan. 18, 2000

[54] FOLDING TREADMILL AND A METHOD OF FOLDING A TREADMILL

[75] Inventors: William E. Clem; Cory R. Williamson; Martin Albini, all of Bozeman, Mont.

[73] Assignee: Conetex, Inc., Elverson, Pa.

[21] Appl. No.: 09/190,988

[22] Filed: Nov. 12, 1998

[51] Int. Cl.[7] ..... A63B 22/02

[52] U.S. Cl. ..... 482/54

[58] Field of Search ..... 482/54

[56] References Cited

U.S. PATENT DOCUMENTS

| | | | |
|---|---|---|---|
| 5,782,723 | 7/1999 | Kuo | 482/54 |
| 5,899,834 | 5/1999 | Dalebout et al. | 482/54 |
| 5,921,893 | 7/1999 | Hurt | 482/54 |

*Primary Examiner*—Glenn E. Richman
*Attorney, Agent, or Firm*—Reed Smith Shaw & McClay LLP

[57] ABSTRACT

A folding treadmill is disclosed which includes a treadmill frame, a carriage connected to the treadmill frame, a lift motor mounted to the carriage, a lift screw connected to the lift motor, a lift arm connected to the lift screw which is extended by turning of the lift screw, and a swinging arm connected to the treadmill frame and to the lift arm. In an alternative embodiment of the present invention, the swinging arm controls the angular orientation of the treadmill frame with respect to the carriage. Further, a method of folding a treadmill is disclosed, including releasing a front axle mechanism connected between a treadmill frame having a front and a rear and a carriage, lifting the front axle mechanism, activating a motor mounted to the carriage to turn a lift screw, extending a lift arm connected to the lift screw by the turning of the lift screw, changing the angular orientation of a swinging arm connected to the rear of the treadmill frame by extending of the lift arm, and causing the rear of the treadmill frame connected to the swinging arm to lift upward from the carriage by extending of the lift arm.

30 Claims, 6 Drawing Sheets

FOLDING TREADMILL AND A METHOD OF FOLDING A TREADMILL

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention is directed generally to a storable exercise apparatus and, more particularly, to a folding treadmill.

2. Description of the Background

Exercise is a necessary element for human health. Walking on a treadmill is a common element in an exercise routine. Such walking increases heart rate, thereby providing a cardiovascular workout, while simultaneously strengthening the muscles of the lower body.

However, treadmills are often used in the home, rather than at the gym. It is desirable that such home-gym treadmills be capable of easy storage for convenience and to avoid the appearance of a cluttered home. It is for this reason that folding treadmills have gained in popularity. Currently, folding treadmills require a complex series of actions by the user to fold the treadmill, or the detachment of some parts which might become easily misplaced.

Additionally, a treadmill user may wish to exercise at a reverse incline (walking backwards uphill) to focus on a different muscle group. However, the ability to change the incline of a treadmill in such a manner also normally requires a complex series of actions or the detachment of parts. This difficulty in varying the inclination of a treadmill may be exaggerated where the variable incline treadmill is also a folding treadmill, which might add additional complexities and detachable parts.

Therefore, the need exists for a folding treadmill that can be folded in a simple manner by a user, and that may be capable of having its angle of inclination varied.

BRIEF SUMMARY OF THE INVENTION

The present invention is directed to an exercise apparatus which allows for varying exercises as well as simple and efficient storage. More particularly, the present invention is directed to a folding treadmill.

In one embodiment of the present invention, the folding treadmill includes a treadmill frame with a hole extending laterally therethrough, a carriage including two legs connected by a crossbar, a liftable front axle mechanism which connects the front of the treadmill frame to the fronts of the carriage legs, a lift motor rotatably mounted to the crossbar of the carriage, a lift screw turnably connected to the lift motor and extending outwardly therefrom, a lift arm connected to the lift screw which is extended by turning of the lift screw, and a swinging arm having two ends and a midpoint, which two ends are connected respectively to the edges of the treadmill frame at the rear edge of the treadmill frame, and which midpoint is connected to the lift arm. In one embodiment of the present invention, the swinging arm controls the angular orientation of the treadmill frame with respect to the carriage, allowing for exercise at a forward, even, or reverse incline.

The present invention also includes a method of folding a treadmill. The method includes lifting a front axle mechanism connected between a treadmill frame having a front and a rear and a carriage by lifting the front axle mechanism, activating a motor mounted to the carriage to turn a lift screw, extending a lift arm connected to the lift screw by the turning of the lift screw, changing the angular orientation of a swinging arm connected to the rear of the treadmill frame by extending of the lift arm, and causing the rear of the treadmill frame connected to the swinging arm to lift upward from the carriage by extending of the lift arm. Optionally, the method may also include releasing the front axle mechanism from the treadmill frame by disengaging a pin.

The present invention solves problems experienced with the prior art in that it allows for a user to exercise on a treadmill, then easily store the treadmill away. Folding allows for this storage, and the present invention allows for folding in a simple manner by the user. Additionally, the nature of the folding mechanisms of the present invention allows for a user to vary the angle of inclination at which the user exercises on the treadmill. Those and other advantages and benefits of the present invention will become apparent from the detailed description of the invention hereinbelow.

BRIEF DESCRIPTION OF THE SEVERAL VIEWS OF THE DRAWING

For the present invention to be clearly understood and readily practiced, the present invention will be described in conjunction with the following figures, wherein.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, many other elements found in a typical treadmill. Those of ordinary skill in the art will recognize that other elements are desirable and/or required in order to implement the present invention. However, because such elements are well known in the art, and because they do not facilitate a better understanding of the present invention, a discussion of such elements is not provided herein.

Figure 1:
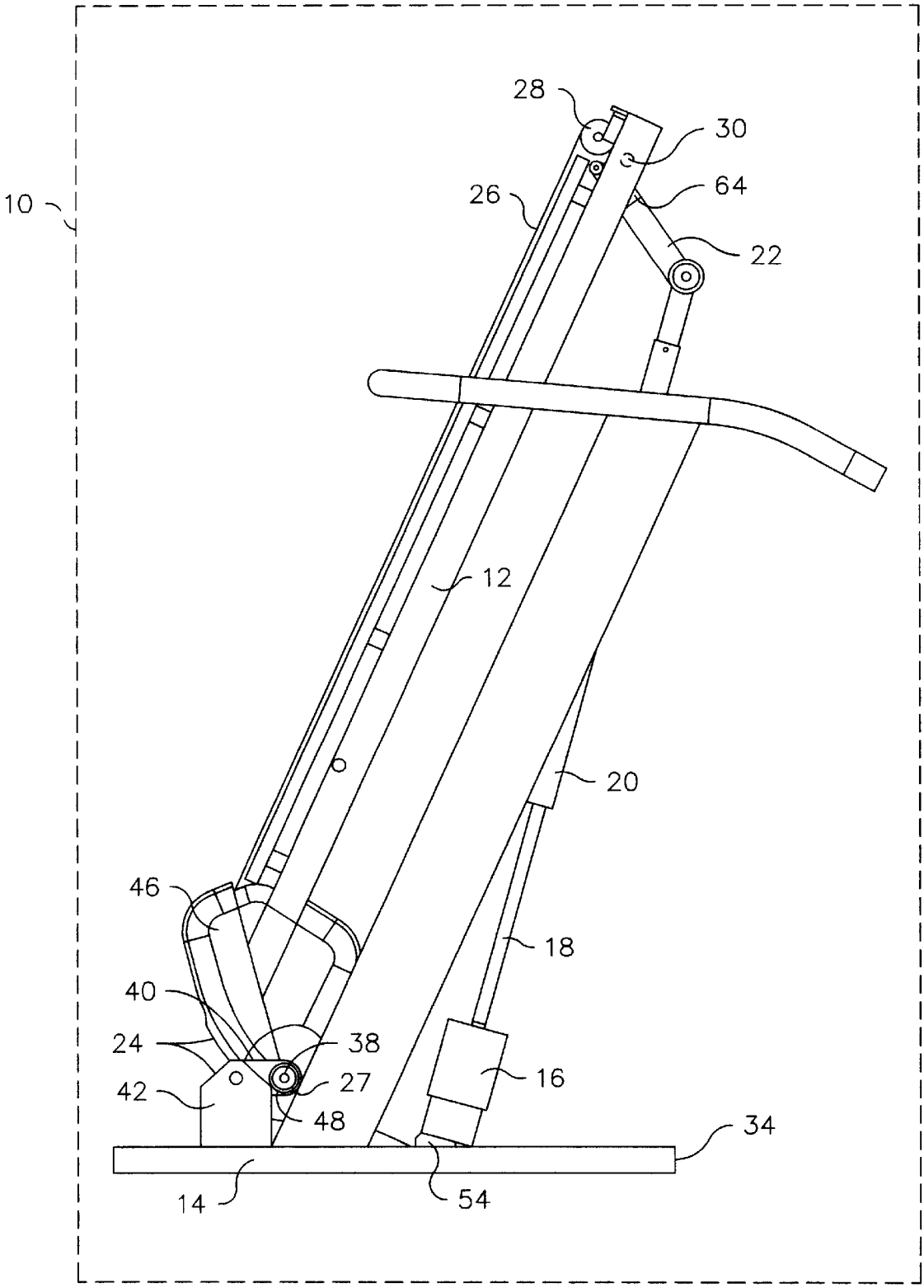
FIG. 1 is a side view of a folding treadmill.

FIG. 1 is a side view of a folding treadmill 10, which includes a treadmill frame 12, a carriage 14, a lift motor 16, a lift screw 18, a lift arm 20, and a swinging arm 22, and which may include a front axle mechanism 24.

The treadmill frame 12 is of the type commonly used in the art. It is multi-edged, and has a continuous belt 26 as a top and bottom surface. The belt surface 26 passes around the periphery of at least two rollers 28 in parallel alignment and having a horizontal axis of rotation. When the belt surface 26 is rolled around the rollers 28 either by the friction provided by the moving feet of a user, or by turning of the rollers by a motor 16, the illusion of motion occurs while the user remains stationary. The continuous belt 26 is preferably constructed of material which is forgiving to the strike of the user's foot, and may include an impact cushion. In one embodiment of the present invention, the treadmill frame 12 has a hole 27 passing though it from one edge to an opposing edge at a point proximate to the front edge of the treadmill frame 12. Additionally, in one embodiment of the present invention, the treadmill frame 12 may have mounted thereon at least two stop pins 30 along the right and left edges of the treadmill frame 12. The stop pins 30 are mounted at a position which prevents further rearward movement of the swinging arm 22 during the folding operation The carriage 14 provides the base for the folding treadmill 10. The carriage 14 rests upon the floor on its bottom surface, and, in the illustrated embodiment, includes at least two legs 34 (also shown in FIG. 5) each having a bottom surface and a top surface, with a crossbar 36 (shown in FIG. 5) connecting the two legs 34 together. This crossbar 36 maintains the legs 34 in a parallel orientation with respect to one another. In an alternative embodiment, the carriage 14 may be a solid piece having any number of sides greater than three to provide adequate stability for the folding treadmill 10 when it is in the folded upright position. The carriage 14 is connected to the front edge of the treadmill frame 12. This connection must allow the front of the treadmill frame 12 to pivot around the carriage 14 when the treadmill is folding. Thus, this connection may be, in a preferred embodiment, a fixed hinge or an axle.

In an alternative embodiment of the present invention, the connection between the treadmill frame 12 and the carriage 14 is a liftable front axle mechanism 24. With such a connection, greater lift for the treadmill frame 12 is provided by allowing the front axle 38 connected to the treadmill frame 12 to rise up from the carriage 14 while the treadmill is being folded into the upright position.

The liftable front axle mechanism 24 includes an axle 38, two axle arms 40 and carriage connectors 42, and may include at least one front pin (not shown). The front axle 38 is an axle of the type commonly used in the art. That axle 38 is passed through the hole 27 near the front edge of the treadmill frame 12 in a manner which allows the ends of the front axle 38 to extend beyond the edges of the treadmill frame 12. In an alternative embodiment, the axle 38 may be passed through a hole 27 in a brace 46, and the brace 46 may be mounted to the front edge of the treadmill frame 12. The pair of axle arms 40 each have a hole 48 through one end. The hole 48 of each axle arm 40 is then fastened around one end of the axle 38. This fastening may be by methods known in the art, and it must allow either for the pivoting of the axle 38 within the axle arm hole 48, or the pivoting of the axle 38 within the treadmill frame 12 or brace hole 27. The second end of each axle arm 40 is then pivotally connected to the front of the carriage legs 34 at the carriage connectors 42. The carriage connectors 42 may be pivoting connectors of the type known in the art, such as pivoting hinges.

In the alternative embodiment of the present invention including a front axle mechanism 24, the front pin may be used to prevent lifting of the front axle mechanism 24 before folding of the treadmill 10. The front pin of the front axle mechanism 24 is detachably connected to the front axle 38 by methods known in the art. For example, the front pin may be placed into a hole passing through the front axle 38, and the pin would then press up against a stop mounted to the treadmill frame 12 or to the brace 46 adjacent to the front axle hole 27, thereby locking the front axle 38 in a then-current position. In a second alternative embodiment using a front latch, a spring latch may be mounted to the carriage 14 to allow the spring latch to clasp over the front axle 38, thereby locking the front axle 38 in a then-current position.

The lift motor 16 provides the force to fold the treadmill 10. The lift motor 16 is mounted to the carriage 14, preferably on the crossbar 36 connecting the carriage legs 34. The lift motor 16 may be of any type capable of turning a screw 18. The lift motor mount 54 must allow the motor 16 to rotate, and thereby maintain a substantially parallel orientation with the treadmill frame 12 when the treadmill 10 is being folded. The placement of this lift motor mount 54 must provide stability when the treadmill 10 is being folded, as well as when the treadmill 10 is in the full upright position. In order to achieve this stability, in one embodiment of the present invention the crossbar 36 connects the legs 34 at their midpoints, thereby placing the mount 54 at the center of gravity of the carriage 14.

The lift screw 18 provides the connection to the motor 16 to allow folding action for the folding treadmill. The lift screw 18 is connected to the lift motor 16 in a manner which allows for the turning of the lift screw 18 by the lift motor 16. In a preferred embodiment of the present invention, the lift screw 18 is locked in a then-current position when the lift motor 16 is powered off. This serves to secure the folding treadmill 10 in a then-current orientation.

The lift arm 20, when extended by turning of the lift screw 18, causes the treadmill frame 12 to rise during the folding process. The lift arm 20 is connected to the lift screw 18 on the end of the lift screw 18 opposite the lift motor 16. When the lift motor 16 turns the lift screw 18, the lift arm 20 is extended. The extension of the lift arm 20 forces the treadmill frame 12 upward from the rear of the treadmill frame 12 when the length of the lift arm 20 extends beyond the length which can be accommodated by the length of the treadmill frame 12 while in an orientation parallel to the ground.

The swinging arm 22 provides for the connection of the lift arm 20 to the treadmill frame 12, as well as providing control of the angle of inclination of the treadmill frame 12 with respect to the ground. The swinging arm 22 includes a main body 62 (shown in FIG. 5), and two ends 64 which are substantially perpendicular to the main body 62. The main body 62 is rotatably connected at its midpoint to the lift arm 20. The two ends 64 are pivotally connected proximate to the rear of the treadmill frame 12, along two edges of the treadmill frame 12. In an alternative embodiment wherein the lift screw 18 does not serve to secure the folding treadmill 10 in a then-current position, the connection of the two ends 64 of the swinging arm 22 to the treadmill frame 12 may serve this purpose. In that alternative embodiment, this connection is in one of two states. The first state is the locked position. In the locked position, the swinging arm 22 is maintained in its position by a latch, and thereby maintains the angle of the rear of the treadmill frame 12 with respect to the ground. The second state is the swinging position. In the swinging position, the swinging arm 22 rotates about the rear of the treadmill frame 12 as necessary to allow for the treadmill frame 12 to be folded into the upright position. This dual state connection may be achieved by methods known in the art, such as a sliding latch with a pin mounted to the treadmill frame 12 and at least one slot on the swinging arm 22 at a position in contact with the edge of the treadmill frame 12.

Figure 2:
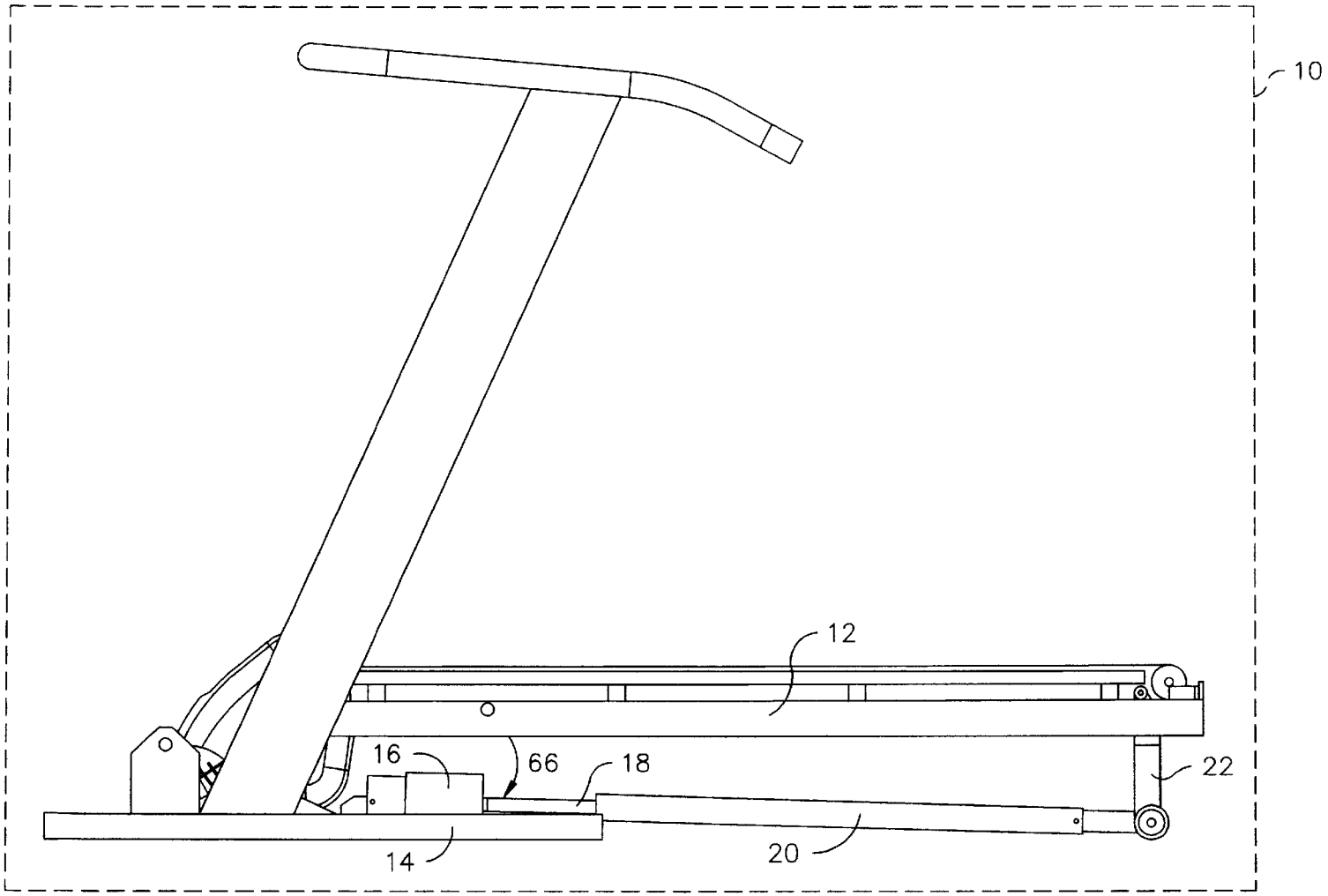
FIG. 2 is a side view illustrating the folding treadmill in the reverse incline position.

FIG. 2 is a side view illustrating the folding treadmill 10 in the reverse incline position 66. The swinging arm 22 may be capable of latching, either by locking of the lift screw 18 or by locking of a swinging arm latch, in several different positions, each causing a different angular orientation of the treadmill frame 12. The treadmill frame 12 may be capable of at least three different angular orientations. These orientations are: angled upward from the rear of the frame 12 to the front of the frame 12, causing the user to simulate an uphill walk; parallel to the ground, causing the user to simulate a walk on level ground; and angled downward from rear to front, causing the user to simulate a downhill walk in a forward walking manner, or an uphill walk in a backward walking manner. The final orientation is a reverse incline treadmill 66. This allows a user to not only exercise in the traditional uphill walking manner, but also to walk in a reverse incline manner, thereby focusing the exercise of muscle groups not sufficiently exercised by the traditional uphill walking treadmill.

Figure 3:
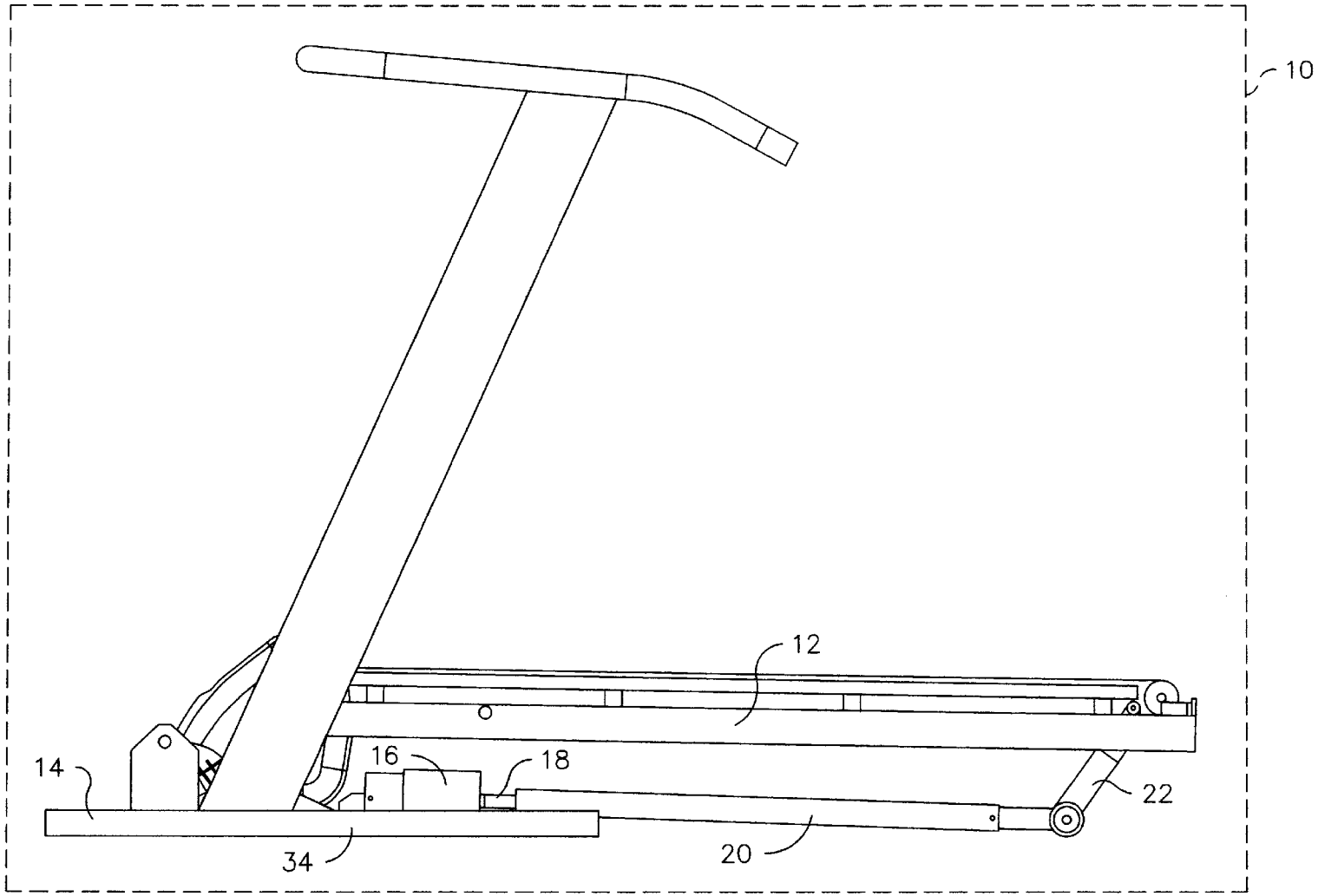
FIG. 3 is a side view illustrating the folding treadmill, including a set of handles.

FIG. 3 is a side view illustrating an alternative embodiment of the folding treadmill 10, which includes a set of handles 168 for the user to grasp in order to maintain balance while using the treadmill 10. In a preferred embodiment of the present invention, one handle 168 is pivotally mounted to each leg 34 of the carriage 14 by methods known in the art, such as an individual axle for each handle, the individual axle passing through a brace mounted to the carriage 14. Connection of the handles 168 to the carriage 14 isolates vibration of the handles 168, passing vibrations into the carriage 14, and then into the ground, rather than subjecting the user to those vibrations. The handles 168 are mounted in an orientation which allows them to be substantially perpendicular to the carriage 14 when the folding treadmill 10 is in use, and may be mounted to rotate to a position substantially parallel to the carriage 14 when the folding treadmill 10 is in the folded upright position.

Figure 4:
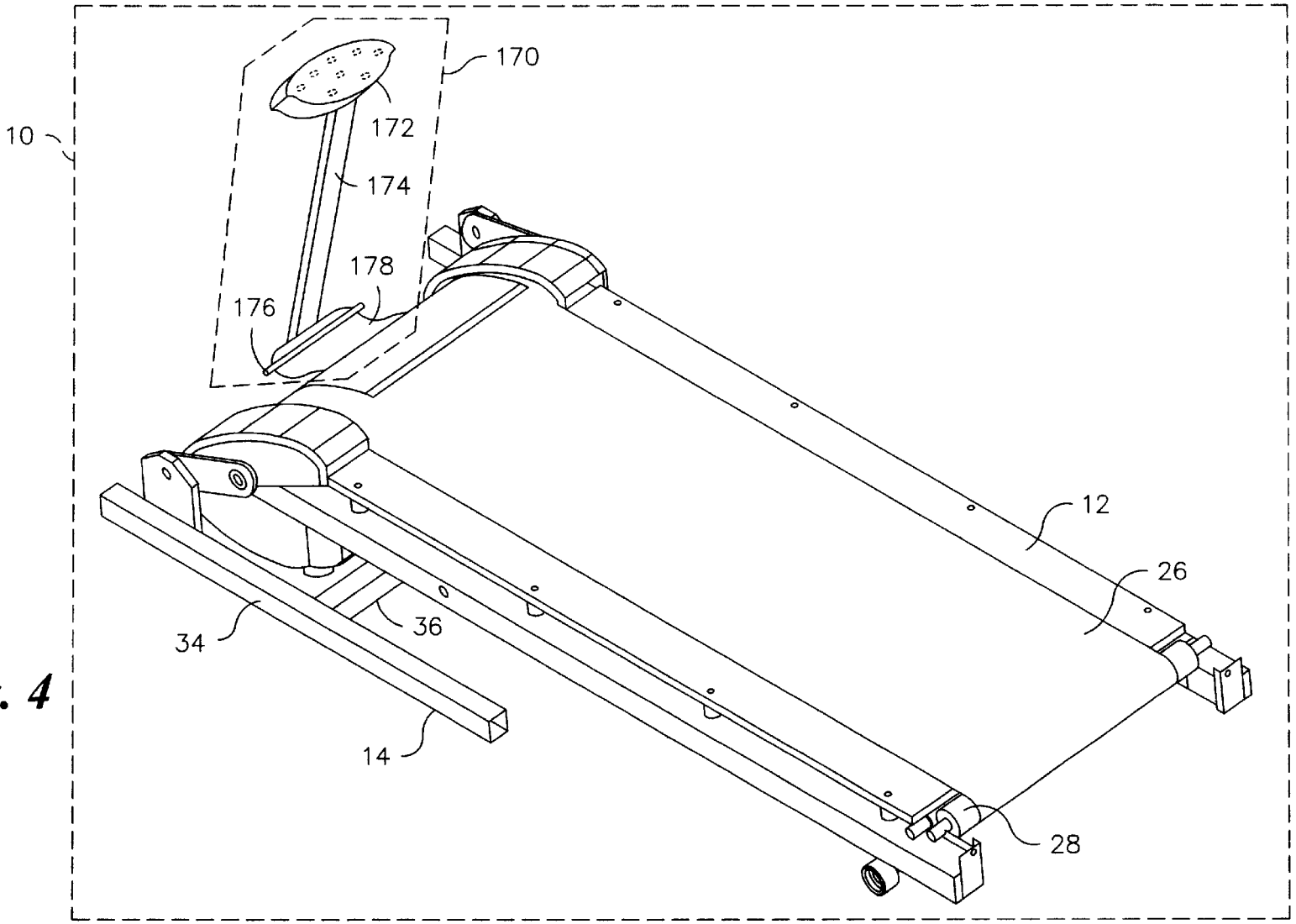
FIG. 4 is an isometric view illustrating the folding treadmill, including an electronics display.

FIG. 4 is an isometric view illustrating an alternative embodiment of the folding treadmill 10, which includes an electronics display 170. The electronics display 170 includes a display screen 172, a hollow stand 174, a hinge mount 176, and a brace 178. The display screen 172 displays thereon statistics related to the user's exercise, which may include but are not limited to, heart-rate and walking speed. The display screen 172 may be of an LED or LCD type, or may be of any type used in the art to display information. The brace 178 is mounted to the front of the treadmill frame 12 in a manner which does not impede movement of the continuous belt 26 or the rollers 28. The hinged mount 176 is connected to the center of the brace 178 on one side, and to the hollow stand 174 on the other. The hollow stand 174 is hollow to allow the wiring and electronics of the display 170 to pass therethrough, and is connected on one end to the hinged mount 176, and on the other end to the display screen 172. The hollow stand 174 is of a length which allows the user to easily view the display screen 172 at one end of the hollow stand 174, while not having the display screen 172 in a position which interferes with exercise. The hinged mount 176 allows the hollow stand 174 to stand perpendicular to the ground when the folding treadmill 10 is in use, and allows the hollow stand 174 to be folded down to contact the treadmill frame 12 when the folding treadmill 10 is to be placed in the folded upright position.

Figure 5:
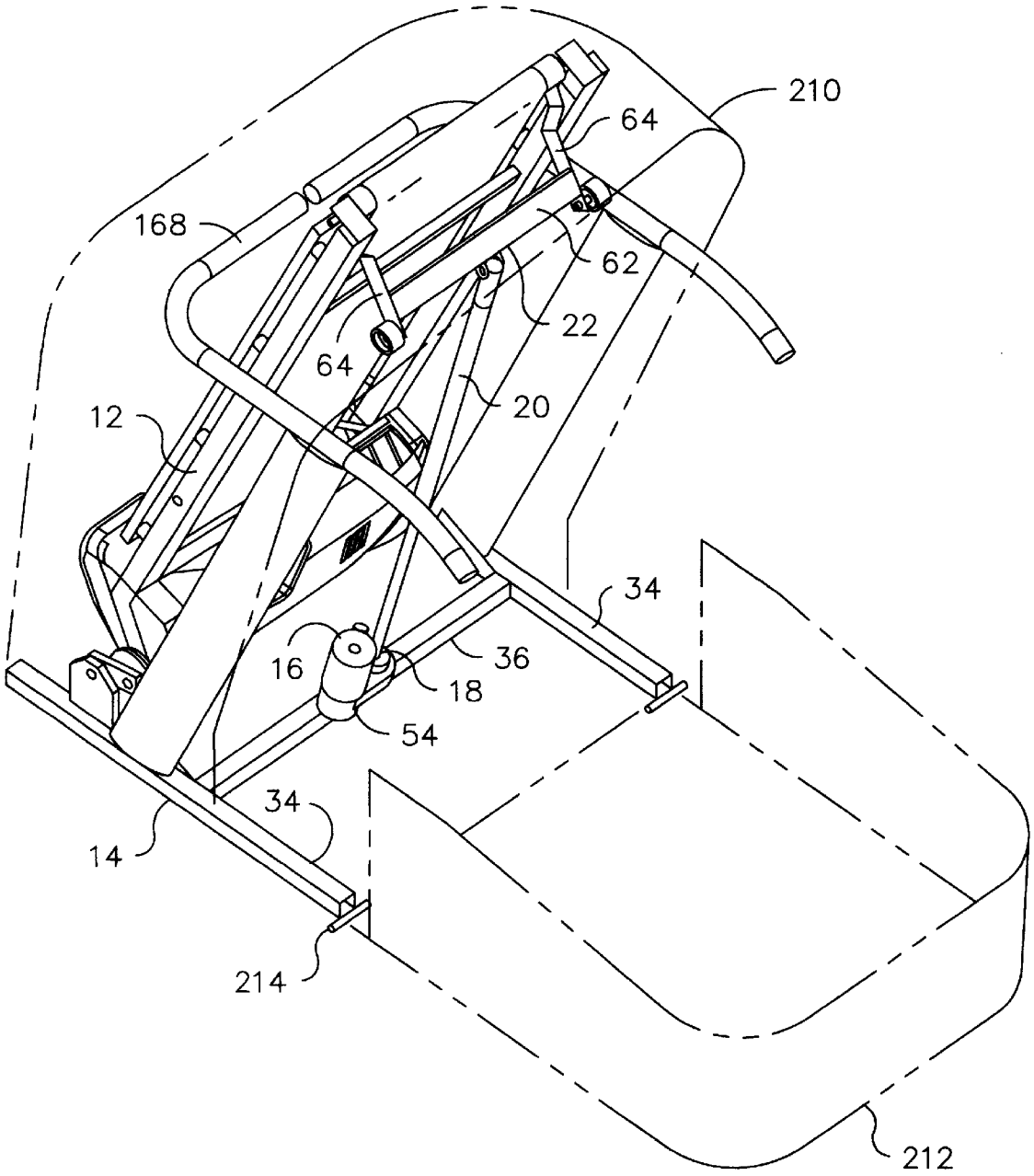
FIG. 5 is an isometric view illustrating the folding treadmill, including an enclosure which covers the folding treadmill.

FIG. 5 is an isometric view illustrating an alternative embodiment of the folding treadmill 10, which includes an enclosure 210 which covers the folding treadmill 10 when it is stowed in the folded upright position. The enclosure 210 may include a closing door 212 which may be hinged 214 to the rear of said carriage 14 to allow for closure upward of the closing door 212 when the folding treadmill 10 is in a folded position, thereby completely enclosing the folding treadmill 10.

In operation, the folding treadmill 10 may begin the folding process when the user disengages the front pins, in an alternative embodiment which includes the front pins. The lift motor 16 is then activated by either the activation of a switch by the user, or a sensor which relays to the lift motor 16 that the front pins have been disengaged. The front axle mechanism 24, where present, may lift up to allow a greater angle of lift once the front pins have been disengaged.

Once activated, the lift motor 16 rotates the lift screw 18, thereby causing extension of the lift arm 20. As the lift arm 20 extends, it pushes the midpoint of the swinging arm 22 toward the rear of the treadmill frame 12. The swinging arm 22 continues to rotate rearward relative to the treadmill frame 12 until the lift arm 20 is fully extended. At that point, the swinging arm 22 hits the stop pins 30 mounted on the right edge and left edge of the treadmill frame 12. Once the swinging arm 22 hits the stop pins 30, the inclination of the treadmill frame 12 begins to increase relative to the front of the carriage 14 as the lift arm 20 is further extended.

Figure 6:
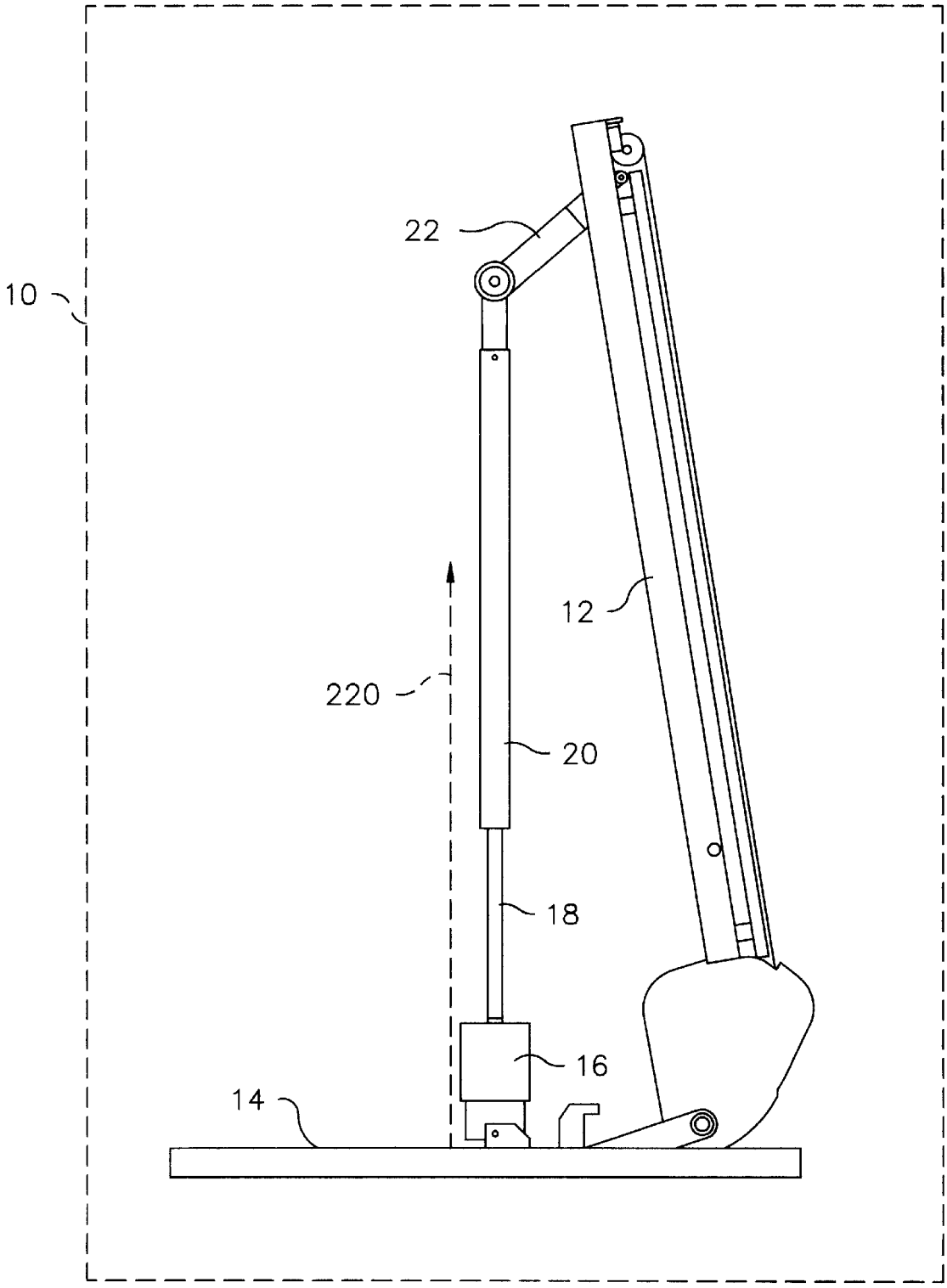
FIG. 6 is a side view of the folding treadmill when folded to a point beyond the center of gravity.

FIG. 6 is a side view of the folding treadmill 10 when it has been folded to a point beyond its center of gravity 220. As inclination increases, the treadmill frame 12 rotates about the connection to the carriage 14 at the front of the treadmill frame 12, and rotates about the connection to the swinging arm 22 at the rear of the treadmill frame 12. The lift motor 16 continues to push the folding treadmill 10 upright until the treadmill frame 12 goes over center 220. The treadmill frame 12 then moves forward for final resting. A spring and damper (not shown) may be connected to prevent the treadmill frame 12 from falling and banging into its final position once it has passed over center 220.

Those of ordinary skill in the art will recognize that many modifications and variations of the present invention may be implemented. For example, in an embodiment of the folding treadmill having handles, those handles may move independently of one another to a forward or rearward position with respect to the other handle, dependent upon which side of the user's body is most forward. The foregoing description and the following claims are intended to cover all such modifications and variations.

What is claimed is:

1. A folding treadmill, comprising:

a treadmill frame having a right edge, a left edge, a front edge, and a rear edge;

a carriage which is pivotally connected to the front edge of said treadmill frame;

a lift motor rotatably mounted to said carriage;

a lift screw having two ends, said lift screw being turnably connected to said lift motor and extending outwardly therefrom;

a lift arm connected to said lift screw on the end of said lift screw opposite said lift motor, whereby extension of said lift arm is driven by turning of said lift screw; and a swinging arm having two ends and a midpoint, said swinging arm being connected at the ends to the right and left edges of said treadmill frame by a pair of pivotal connectors, and being connected at the midpoint to said lift arm.

2. The folding treadmill of claim 1, wherein said carriage is pivotally connected to said treadmill frame by a front axle mechanism, comprising:

a front axle having two axle ends which extend beyond the right and left edges of said treadmill frame, said front axle being connected to said treadmill frame;

a pair of axle arms, each having two ends, wherein one end of the two ends has a hole passing therethrough, and wherein the hole is connected about one axle end of said front axle; and a carriage connector which is fastened to said carriage and which is fastened to said pair of axle arms.

3. The folding treadmill of claim 2, further comprising at least one front pin detachably connected to the front axle mechanism.

4. The folding treadmill of claim 3, wherein said front pin is placed into a hole passing through said front axle to lock said front axle in a position.

5. The folded treadmill of claim 3, further comprising a spring latch mounted to said carriage, wherein said spring latch is mounted to allow said spring latch to clasp over said front axle, thereby locking said front axle in a position.

6. The folding treadmill of claim 1, wherein said carriage is pivotally connected to said treadmill frame by a connector chosen from the group consisting of a hinge and an axle.

7. The folding treadmill of claim 1, wherein a cessation of operation by said lift motor locks said lift screw in a then-current position, thereby locking the folding treadmill in a then-current position.

8. The folding treadmill of claim 1, wherein said carriage includes:

two legs in a parallel orientation, each leg having a top surface, a bottom surface, and a midpoint; and a cross bar which connects said two legs.

9. The folding treadmill of claim 8, wherein said lift motor is rotatably mounted to said carriage on said crossbar of said carriage.

10. The folding treadmill of claim 1, wherein said carriage includes a base having at least three sides, a top surface, and a bottom surface.

11. The folding treadmill of claim 1, further comprising a pair of handles, wherein each handle is pivotally mounted to said carriage to allow for an orientation of the handles with respect to the carriage, the orientation being chosen from the group consisting of a substantially perpendicular orientation and a substantially parallel orientation.

12. The folding treadmill of claim 1, further comprising an electronics display, wherein said electronics display comprises:

a display screen;

a hollow stand having a first end connected to said display screen and having a second end;

a plurality of wires passing through said hollow stand, said plurality of wires being connected on one end to said display screen, and on the other end to an informational relay;

a hinged mount having a first side and a second side, wherein the first side is connected to the second end of said hollow stand; and a brace having two ends and a midpoint, wherein the two ends are connected to said treadmill frame, and wherein the midpoint of said brace is connected to the second side of said hinged mount.

13. The folding treadmill of claim 1, further comprising an enclosure which covers the folding treadmill when the folding treadmill is in a folded position.

14. The folding treadmill of claim 13, wherein said enclosure includes a closing door, which closing door is hinged to the rear of said carriage to allow for closure upward of the closing door when the folding treadmill is in a folded position, thereby completely enclosing the folding treadmill.

15. The folding treadmill of claim 1, further comprising a spring and damper connected to prevent banging during folding of the folding treadmill.

16. The folding treadmill of claim 1, wherein said treadmill frame includes at least two stop pins mounted on the right edge and left edge of said treadmill frame, said stop pins being mounted at a position which prevents further rearward movement of said swinging arm when the folding treadmill is being folded.

17. The folding treadmill of claim 1, wherein said treadmill frame includes an impact cushion.

18. The folding treadmill of claim 1, wherein said lift motor is mounted to said carriage at a center of gravity of said carriage.

19. The folding treadmill of claim 1, wherein said pair of pivotal connectors comprises a pair of sliding latches.

20. The folding treadmill of claim 19, wherein each sliding latch connected to said swinging arm is capable of being latched in at least three positions.

21. The folding treadmill of claim 20, wherein each of the positions are chosen from the group consisting of forward incline, no incline, and reverse incline.

22. The folding treadmill of claim 1, wherein said swinging arm controls angular orientation of said treadmill frame with respect to said carriage.

23. The folding treadmill of claim 22, wherein said treadmill frame is oriented in an incline with respect to the rear edge of said treadmill frame.

24. The folding treadmill of claim 22, wherein said treadmill frame is oriented in an incline with respect to the front edge of said treadmill frame.

25. A folding treadmill, comprising:

a treadmill frame having a first end, a second end, a right end, and a left end, wherein the first end has a hole extending laterally therethrough;

a carriage including two legs, each having a front, a rear, a top, and a bottom, the two legs being connected by a crossbar;

a front axle having two ends, said front axle being passed through the hole of the first end of said treadmill frame to allow the two ends of said front axle to extend beyond the right end and the left end of said treadmill frame;

a pair of axle arms, each having a first end, with a hole therethrough, and a second end, wherein the hole is fastened pivotally around one end of said front axle, and wherein the second end is pivotally connected to the front of one leg of said carriage;

a lift motor rotatably mounted to the crossbar of said carriage;

a lift screw having two ends, said lift screw being turnably connected to the lift motor and extending outwardly therefrom;

a lift arm connected to said lift screw on the end of said lift screw opposite said lift motor, whereby extension of said lift arm is driven by turning by said lift motor of said lift screw; and a swinging arm having two ends and a midpoint, said swinging arm being connected at the ends to the right and left edges of said treadmill frame at the rear edge of said treadmill frame by a pair of sliding latches, and said swinging arm being connected at the midpoint to said lift arm, and wherein said swinging arm controls angular orientation of said treadmill frame with respect to said carriage.

26. A folding treadmill, comprising:

a treadmill frame having a first end, a second end, a right end, and a left end, wherein the first end has a hole extending laterally therethrough;

a carriage including two legs, each having a front, a rear, a top, and a bottom, the two legs being connected by a crossbar;

a front axle having two ends, said front axle being passed through the hole of the first end of said treadmill frame to allow the two ends of said front axle to extend beyond the right end and the left end of said treadmill frame;

means for providing additional lift to said front axle with respect to said carriage;

a lift arm;

means for extending said lift arm; and means for controlling angular orientation of said treadmill frame with respect to said carriage, said means for controlling angular orientation being connected between said treadmill frame and said lift arm.

27. A reverse incline treadmill, comprising:

a treadmill frame having a right edge, a left edge, a front edge, and a rear edge;

a carriage which is pivotally connected to the front edge of said treadmill frame; and a swinging arm which controls angular orientation of said treadmill frame, said swinging arm having two ends and a midpoint, said swinging arm being connected at the ends to the right and left edges of said treadmill frame by a pair of sliding latches which latch in a position which raises the rear edge of said treadmill frame to a height greater than the front edge of said treadmill frame, and said swinging arm being connected at the midpoint to said carriage.

28. The reverse incline treadmill of claim 27, further comprising:

a lift motor mounted to said carriage;

a lift screw threadedly connected to said lift motor and extending therefrom;

a lift arm having two ends, wherein one end is connected to said lift screw, and wherein the other end is connected to the midpoint of said swinging arm to allow turning by said lift motor of said lift screw to extend said lift arm, thereby moving said swinging arm toward the rear edge of said treadmill frame, and thereby raising the rear edge of said treadmill frame to a height greater than the front edge of said treadmill frame.

29. The reverse incline treadmill of claim 27, further comprising a pair of handles, wherein each handle is mounted to said carriage and is oriented perpendicularly to said treadmill frame.

30. A method for folding a treadmill, comprising:

releasing a front axle mechanism connected between a treadmill frame having a front and a rear and a carriage by disengaging at least one front pin;

lifting said front axle mechanism;

activating a motor mounted to said carriage to turn a lift screw;

extending a lift arm connected to said lift screw;

changing the angular orientation of a swinging arm connected to the rear of said treadmill frame by said extending of said lift arm; and causing the rear of said treadmill frame connected to said swinging arm to lift upward from said carriage by said extending of said lift arm.

* * * * *